US005093077A

United States Patent [19]

Kessler

[11] Patent Number: 5,093,077

[45] Date of Patent: Mar. 3, 1992

[54] COMPOSITION FOR THE CONTROL OF CORROSION ON IRON SURFACES IN WATER SYSTEMS

[75] Inventor: Stephen M. Kessler, Fairless Hills, Pa.

[73] Assignee: Betz Laboratories, Inc., Trevose, Pa.

[21] Appl. No.: 388,414

[22] Filed: Aug. 2, 1989

[51] Int. Cl.[5] ..... C23F 11/00

[52] U.S. Cl. ..... 422/12; 422/16; 422/17; 252/391; 252/392

[58] Field of Search ..... 422/12, 16–17; 252/391, 392

[56] References Cited

U.S. PATENT DOCUMENTS

| | | | |
|---|---|---|---|
| 3,598,756 | 8/1971 | Heit | 252/389 |
| 3,699,047 | 10/1972 | Petrey | 252/175 |
| 4,443,340 | 4/1984 | May et al. | 210/697 |
| 4,789,523 | 12/1988 | Schilling et al. | 422/12 |

*Primary Examiner*—Robert J. Warden
*Assistant Examiner*—Lyle A. Alexander
*Attorney, Agent, or Firm*—Alexander D. Ricci; Gregory M. Hill

[57] ABSTRACT

A composition and method for inhibiting corrosion on metallic surfaces which either have been immersed in and removed from an aqueous medium or are partially immersed in a static aqueous medium. The invention comprises adding to an aqueous medium a composition comprising ammonium lignosulfonate, $NO_2$, $B_4O_7$ and $SiO_2$.

9 Claims, No Drawings

COMPOSITION FOR THE CONTROL OF CORROSION ON IRON SURFACES IN WATER SYSTEMS

FIELD OF THE INVENTION

This invention relates to the control of corrosion on metallic surfaces which are in contact with aqueous media. Specifically, systems where the aqueous/metallic interface is static are the primary focus of the present discovery.

BACKGROUND OF THE INVENTION

This invention relates to water systems in contact with metallic surfaces, especially iron. Contact between water and the unprotected surface of iron, such as cast iron, or iron containing materials will result in the creation of a layer of ferric oxide, more commonly known as rust, on the metallic surface.

In certain industrial applications, cast iron components are subjected to conditions in which they are in contact with water. One such operation involves the production of cast iron diesel engines. During one phase of quality control testing of these engines, they are filled with water, drained and then removed to a storage location. The most corrosive environments can be found at the locations of stagnant pockets of residual water.

Under conditions where the metal is fully immersed in a dynamic environment, nitrite, borate, and silicate combinations have been utilized to effectively control corrosion for low carbon steel and cast iron. However, effective corrosion control cannot be maintained using these inhibitors either independently or in combination under stagnant, partially immersed conditions such as has been described above in the process of manufacturing diesel engines.

PRIOR ART

In U.S. Pat. No. 3,699,047, Petrey, a composition and method of inhibiting corrosion and scale deposition in cooling water systems are disclosed. It consists of a composition comprised of either a sodium, ammonium or potassium lignosulfonate, and alkyl sulfonic acid and a divalent metal ion such as zinc or cadmium. The focus of the invention of this patent is for use in a dynamic system in which water is constantly moving past the metallic components.

U.S. Pat. No. 3,598,756, Heit, discloses a corrosion inhibitor for use in cooling water systems. The patentee discloses a composition comprised of a polyvalent metal salt such as zinc, a nitrogen containing thio compound and a lignosulfonate, specifically limited to the calcium, potassium and sodium compounds thereof.

In U.S. Pat. No. 4,443,340, May et al., a corrosion inhibitor is disclosed for use in cooling water systems in which a protective oxide layer is laid down on the surface of the metallic parts in contact with the cooling water. The composition of the invention is comprised of a copolymer, an orthophosphate, and an ion selected from the group of zinc, nickel or chromium and sodium lignosulfonate.

GENERAL DESCRIPTION OF THE INVENTION

It is an object of this invention to provide a composition and method to control corrosion on metallic surfaces which are in contact with a static aqueous medium.

Lignins are known corrosion inhibitors. Different species of lignins impart various degrees of corrosion inhibition depending upon the metallurgical make up of the substrate and the composition of the aqueous medium.

It has been discovered that a specific lignin, ammonium lignosulfonate, in accordance with the composition and method of the present invention exhibits surprisingly improved corrosion inhibition properties in the severely corrosive environment described herein.

DETAILED DESCRIPTION OF THE INVENTION

It has been unexpectedly discovered that a composition comprising a specific lignosulfonate provides highly efficacious inhibition against the corrosion of metallic surfaces in certain aqueous environments. The environment known to be the most corrosive is a static aqueous system. This is defined as an aqueous medium that is stagnant. The most corrosive environment includes the partial immersion of a metallic material in a static aqueous medium. Corrosion is most severe at the water/metal/air interface.

The composition according to the present invention comprises ammonium lignosulfonate, $NO_2$, $B_4O_7$ and $SiO_2$. This composition exhibits synergistic anti-corrosive properties more significant than the individual efficacies of the ammonium lignosulfonate or the remaining corrosive inhibiting agents when used individually. Although various lignosulfonates provide some degree of corrosion inhibition, only ammonium lignosulfonate combined with $NO_2$, $B_4O_7$ and $SiO_2$ has exhibited a desirable level of efficacy.

The composition is added to the aqueous medium in a sufficient amount to inhibit corrosion on the surfaces of the metallic components introduced into the medium. Effective levels are as follows:

| | Composition Weight % | Concentration in Solution |
|---|---|---|
| Ammonium lignosulfonate | 0.01–0.2 | 100–2000 ppm |
| $NO_2$ | 0.001–0.2 | 10–2000 ppm |
| $B_4O_7$ | 0.001–0.1 | 10–1000 ppm |
| $SiO_2$ | 0.001–0.1 | 10–1000 ppm |

EXAMPLES

The following testing was conducted to simulate the corrosive condition experienced by a diesel engine manufacturer in the processing of cast iron diesel engine blocks. During the conducting of one of the quality control checks, the engines are filled with cycled tower water and operated for 40 to 50 minutes at a water temperature of 180° F. to 200° F. The engines are then drained, capped, and stored. The cast iron surfaces are most prone to corrosion at this time due to residual pockets of cooling water.

Cast iron coupons were immersed in cooling water at 200° F. for 60 minutes. The water contained 60 ppm calcium, 40 ppm magnesium, 170 ppm M—Alk (all as $CaCO_3$), 2.3 ppm $SiO_2$, 42 ppm Cl, and 60 ppm $SO_4$. After initial exposure, the coupons were removed and then re-immersed half way into the water to approximate as closely as possible the effect on the engine surfaces upon draining. Treatment efficacy was determined by coupon appearance and by weight loss data, indicating the level of corrosive attack, obtained after seven days under these test conditions. This data is shown below in Table I.

TABLE I

Cast-Iron Coupon Testing
Water Conditions:
pH = 10.0
60 ppm Ca, 40 ppm Mg, 170 ppm M-alk (all as $CaCO_3$)
42 ppm cl, 60 ppm $SO_4$, 2.3 ppm $SiO_2$

| Treatment | Composition | Concentration |
|---|---|---|
| A | $NO_2$ | 600 ppm |
| | $B_4O_7$ | 200 ppm |
| | $SiO_2$ | 230 ppm |
| | Ammonium Lignosulfonate | 1250 ppm |
| | HEDP | 5 ppm |
| B | $NO_2$ | 600 ppm |
| | $B_4O_7$ | 200 ppm |
| | Sodium Lignosulfonate[1] | 1250 ppm |
| | $SiO_2$ | 230 ppm |
| | HEDP | 5 ppm |
| C | $NO_2$ | 600 ppm |
| | $B_4O_7$ | 200 ppm |
| | Sodium Lignosulfonate[2] | 1250 ppm |
| | $SiO_2$ | 230 ppm |
| | HEDP superscript[3] | 5 ppm |

Test Results

| Treatment | Coupon Appearance After Initial 60 Minute Immersion | Coupon Appearance During Partial Immersion after one day | Coupon Appearance During Partial Immersion after seven day | Weight Loss in mgs (7 days) |
|---|---|---|---|---|
| A | CLEAN | CLEAN | CLEAN | 0.6 |
| B | CLEAN | LIGHT ATTACK OF EXPOSED COUPON SURFACE AND MODERATE ATTACK AT INTERFACE | MODERATE ATTACK OF EXPOSED SURFACE AND SEVERE ATTACK AT INTERFACE | 19.7 |
| C | CLEAN | LIGHT ATTACK OF EXPOSED COUPON SURFACE AND MODERATE ATTACK AT INTERFACE | MODERATE ATTACK OF BOTH EXPOSED AND INTERFACE SURFACES | 17.2 |

[1]Reax 88B
[2]Lignosol XD
[3]1-hydroxyethylidene diphosphonic acid

The treatment composition containing the ammonium lignosulfonate exhibited exceptional corrosion protection. Both the unimmersed and immersed portions of the cast iron coupons remained exceptionally clean throughout the seven day test period. When the other lignosulfonates, REAX 88B and lignosol XD, were utilized instead of the ammonium lignosulfonate, corrosion of the unimmersed and coupon/solution interfacial areas was always evident. Only the ammonium lignosulfonate was able to completely protect the cast iron surfaces. It appears that the ammonium lignosulfonate enhances the formation of a very tenacious, passive film on the cast iron surface. This film provides the cast iron surface with a level of protection heretofore unavailable with prior corrosion inhibitors.

It can thus be seen that the disclosed invention carries out the objects set forth above. The best mode for carrying out those objects have been disclosed. However, it will be apparent to those skilled in the art that many other modifications can be made without departing from the invention herein disclosed and described.

We claim:

1. A composition for inhibiting corrosion on iron containing surfaces which come in contact with a static aqueous medium comprising within an aqueous medium $NO_2$, $B_4O_7$, $SiO_2$, ammonium lignosulfonate and 1-hydroxyethylidene diphosphonic acid.

2. A composition according to claim 1 comprising:
a) from about 0.001 wt. % to about 0.2 wt. % of $NO_2$,
b) from about 0.001 wt. % to about 0.1 wt. % of $B_4O_7$,
c) from about 0.001 wt. % to about 0.1 wt. % of $SiO_2$,
d) from about 0.001 wt. % to about 0.1 wt. % of ammonium lignosulfonate and
c) from about 0.0005 wt. % to about 0.002 wt. % of 1-hydroxyethylidene diphosphonic acid.

3. A composition according to claim 1 comprising:
a) approximately 0.06 wt. % of $NO_2$,
b) approximately 0.02 wt. % of $B_4O_7$,
c) approximately 0.023 wt. % of $SiO_2$,
d) approximately 0.125 wt. % of ammonium lignosulfonate and
e) approximately 0.0005 wt. % of 1-hydroxyethylidene diphosphonic acid.

4. A method of inhibiting corrosion on metallic surfaces in contact with a static aqueous medium comprising adding to said aqueous medium a sufficient amount for the purpose of a composition comprising $NO_2$, $B_4O_7$, $SiO_2$, ammonium lignosulfonate and 1-hydroxyethylidene diphosphonic acid.

5. A method according to claim 4 wherein said metallic surfaces contain iron.

6. A method according to claim 4 wherein the concentration of $NO_2$is from 10 to 2000 ppm, the concentration of said $B_4O_7$ is from 10 to 1000 ppm, the concentration of said $SiO_2$ is from 10 to 1000 ppm, the concentration of said ammonium lignosulfonate is from 10 to 2000 ppm and the concentration of said 1-hdyroxyethylidene diphosphonic acid is from 2.5 to 20 ppm.

7. A method according to claim 4 wherein the concentration of said $NO_2$ is 600 ppm, the concentration of said $B_4O_7$ is 200 ppm, the concentration of said $SiO_2$ is 230 ppm, the concentration of said ammonium lignosulfonate is 1250 ppm and the concentration of said 1-hydroxyethylidene diphosphonic acid is 5 ppm.

8. A method according to claim 4 wherein said metallic surfaces are partially immersed in said aqueous medium.

9. A method according to claim 4 wherein said metallic surfaces are first immersed in said aqueous medium and subsequently removed therefrom.

* * * * *